United States Patent [19]

Gilman

[11] 4,446,666

[45] May 8, 1984

[54] TETRAHEDRAL TRUSS

[75] Inventor: John J. Gilman, Convent Station, N.J.

[73] Assignee: Allied Corporation, Morris Township, Morris County, N.J.

[21] Appl. No.: 216,047

[22] Filed: Dec. 15, 1980

Related U.S. Application Data

[63] Continuation-in-part of Ser. No. 54,497, Jul. 3, 1979, abandoned.

[51] Int. Cl.[3] ..... E04H 12/00

[52] U.S. Cl. ..... 52/648; 52/DIG. 10; 434/277; 434/281

[58] Field of Search ..... 52/DIG. 10, 637, 648, 52/79.1, 79.2, 79.4; 434/278–281, 277

[56] References Cited

U.S. PATENT DOCUMENTS

| | | | |
|---|---|---|---|
| 856,838 | 6/1907 | Bell | 52/DIG. 10 |
| 3,080,662 | 3/1963 | Branlik | 434/278 |
| 3,139,959 | 7/1964 | Kraft | 189/34 |
| 3,148,539 | 9/1964 | Cook | 52/DIG. 10 |
| 3,230,643 | 1/1966 | Mathus | 434/278 |
| 3,333,349 | 8/1967 | Brumlik | 35/18 |
| 3,354,591 | 11/1967 | Fuller | 52/81 |
| 3,494,578 | 2/1970 | Cureton | 52/DIG. 10 |
| 3,600,825 | 8/1971 | Pearce | 52/DIG. 10 |
| 3,696,574 | 10/1972 | Dietrich | 52/637 |
| 3,707,813 | 1/1973 | Cymbrowitz | 52/DIG. 10 |
| 3,722,153 | 3/1973 | Baer | 52/DIG. 10 |
| 3,853,418 | 12/1974 | Drain | 52/98 |
| 3,970,301 | 7/1976 | Lehmann | 52/DIG. 10 |
| 4,030,209 | 6/1977 | Drelding | 434/278 |
| 4,207,715 | 6/1980 | Kitrick | 52/DIG. 10 |

FOREIGN PATENT DOCUMENTS

| | | | |
|---|---|---|---|
| 712758 | 7/1965 | Canada | 434/278 |

OTHER PUBLICATIONS

*Space Grid Structures* by John Borrego ©1968 MIT pp. 80 and 81, 18–21, 102 and 103.

*Primary Examiner*—Henry E. Raduazo
*Attorney, Agent, or Firm*—Paul Yee; Ernest D. Buff

[57] ABSTRACT

A three-dimensional, tetrahedral truss and its method of construction are provided. The truss comprises a three-dimensionally periodic skeletal array of an interconnected plurality of skeletal-tetrahedric units, the array being in the pattern of the crystallographic structure known as "cubic-diamond" (FIG. 1). Each of the skeletal-tetrahedric units is a skeletal arrangement of elongate members joined in the pattern of an equilateral skeletal tetrahedron (FIG. 4), and is preferably assembled from four hexagonic triplanar-rings (FIG. 4A) being of the form created by joining six bilateral-elements in a closed ring, triplanar pattern (FIG. 3), the bilateral-elements each having equal sides and having an included angle of about 109°28′ (FIG. 3).

7 Claims, 15 Drawing Figures

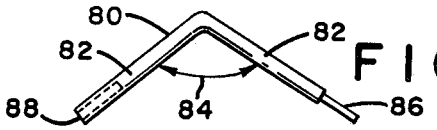
FIG. 3
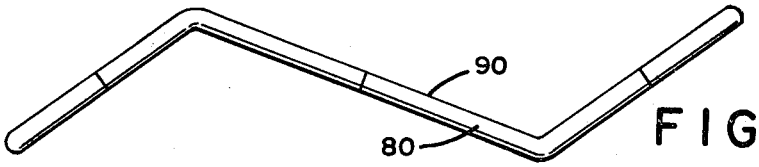
FIG. 3B
FIG. 3C
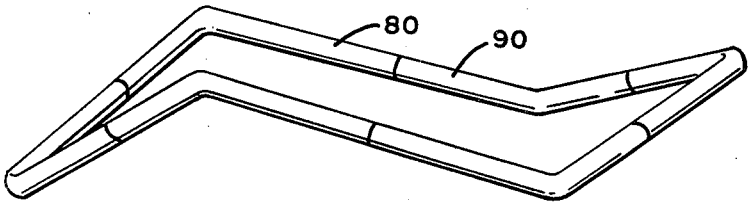
FIG. 3A
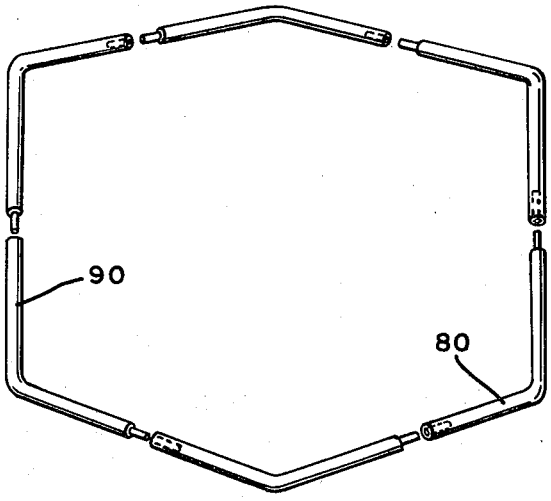

TETRAHEDRAL TRUSS

DESCRIPTION

Cross-Reference to Related Applications

This application is a continuation-in-part of my copending application Ser. No. 054,497, filed July 3, 1979, entitled "Tetrahedral Truss" and now abandoned.

BACKGROUND OF THE INVENTION

This invention relates generally to structural frames and other articulated supporting structures. More specifically to three-dimensional structural trusses, i.e., supporting structures whose primary load-bearing capacity is attributable to extension of the structure in three dimensions.

A structural truss may generally be considered to be an open, skeletal assembly of struts joined at nodes to achieve a supporting structure of high load-bearing capacity relative to its weight, i.e., high specific-structural strength. Trusses are usually based on the geometric triangle to take advantage of its inherent rigidity in supporting a coplanar load.

The struts of a truss are commonly straight and joined together at nodes by means of various types of male and female coupling devices. Thus, the struts are discontinuous. But some of the highest specific-strength materials consist of strong filaments embedded in less strong matrices, and such materials are difficult to join to coupling devices without introducing substantial extra weight. Thus, it is desirable to use continuous strut-like members that do not need nodal coupling devices in forming light-weight structures.

The present invention provides a truss that uses specially designed, articulated, ring-like members for its struts. It is fundamentally periodic in three dimensions. Its geometric form causes it to have three-dimensional stability without depending on lateral stabilizing members or complex networking. As a result of its periodicity, the truss may be built up in a regular fashion by "repeating" a fundamental unit in the three dimensions to the extent desired. Further, this truss design continues to take advantage of the inherent rigidity of the skeletal triangle. Still further, the truss design achieves these advantages with maximum geometric efficiency, i.e., the minimum number of struts per node (four) that is required for stability of an articulated, periodic, 3D structure. This provides a maximum of open space in the structure; thereby improving its usefulness.

SUMMARY OF THE INVENTION

In attainment of the above-mentioned advantages over conventional trusses based on the 2D triangle, the present invention provides a truss based on the "3D triangle", i.e., the equilateral tetrahedron, which is the most stable elemental geometric configuration. Accordingly, the present invention provides a three-dimensional tetrahedral truss comprising a three-dimensionally periodic skeletal array of an interconnected plurality of skeletal-tetrahedric units, said array being in the pattern of the crystallographic structure known as "cubic-diamond" (FIG. 1). The method of the invention provides for the construction of such a truss from elemental units.

The skeletal tetrahedric units are related to "diamond saddle polyhedra" as described by Pearce (Structure in Nature is a Strategy for Design—Peter Pearce, The MIT Press, Cambridge, Mass., 1978). However, they differ in structure, being skeletal rather than blocky and in the method by which the skeletal-tetrahedric units are constructed.

Conventionally, each of the skeletal-tetrahedric units would be an articulated arrangement of struts joined in the pattern of an equilateral skeletal-tetrahedron (FIG. 2). The struts could be received and joined at a male-node (FIG. 2A), or at a female-node (FIG. 2B). In combination, the struts could be of high stiffness, relative to the node, and the node could be of high toughness, relative to the struts, thereby blending these advantageous mechanical properties in a composite structure. However, unless the nodes and struts can be welded together, this arrangement results in discontinuities between the nodes and struts. Furthermore, these discontinuities are places of exceptional weakness if the struts are constructed from filamentary composite materials.

Preferably, each of the units is a skeletal arrangement of elongate members joined in the pattern needed to form a cubic-diamond unit-cell (FIG. 1). Such a skeletal-tetrahedric unit (FIG. 4) may be assembled from four hexagonic triplanar-rings which are of the form created by joining six bilateral elements (FIG. 3A) into a closed, triplanar, ring pattern (FIGS. 3B,C); wherein each of the bilateral-elements is defined as having equal sides and having an included tetrahedral-angle of about 109 degrees, 28 minutes of arc (FIG. 3A). The triplanar-rings may in fact be constructed of the bilateral-elements, or they may be formed as jointless rings.

The truss can be assembled by aggregating the skeletal-tetrahedric units (FIGS. 5,5A,6A). Any desired size (or general shape) can be obtained since the assembly process is periodic.

The truss formed in this way has more open space (for a given stiffness of the structure) than comparable conventional 3D trusses. This open space consists of six sets of channels (tunnels) that penetrate the structure; as compared with the three sets that penetrate a simple cubic truss.

The truss may be a graded structure wherein the characteristic dimension of the said skeletal-tetrahedric units varies within the said truss by an integer power of the fraction one-half (FIG. 6,6A). The "characteristic dimension" is defined as the length of a side of the hexagonic rings that constitute the tetrahedric units.

Additionally, the scope of the invention broadly comprehends the above described structural elements per se.

BRIEF DESCRIPTION OF THE DRAWINGS

Further details are given below with reference to the embodiments shown in the drawings wherein:

FIGS. 3, 3A, 3B, and 3C form a sequence showing, respectively, a bilateral-element having equal sides about an included-angle of about 109 degrees, 28 minutes of arc; an exploded-plan-view of a hexagonic triplanar ring as assembled from six bilateral-elements; a side view of the assembled ring; and a hexagonic triplanar ring-element in perspective.

DESCRIPTION OF THE PREFERRED EMBODIMENTS

Figure 1:
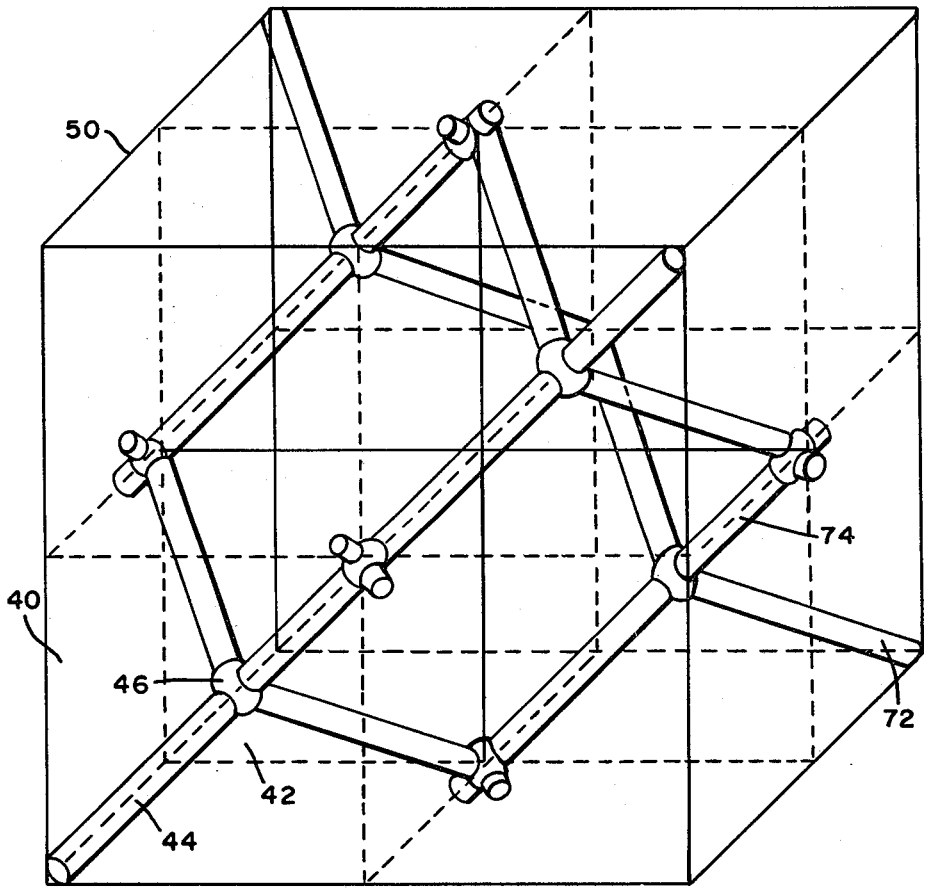
FIG. 1 PRIOR ART
FIG. 1 shows the placement of four articulated skeletal-tetrahedric units into the pattern of cubic-diamond.

Referring specifically to the drawings, in FIGS. 1 and 1A, the cubic diamond structure consisting of four linked skeletal-tetrahedric units is shown for definitional purposes. The skeletal-tetrahedron 12 (FIG. 2) may be throught of as consisting of four struts 14 joined at a node 16 and externally terminating at the four apexes, respectively, of the phantom reference tetrahedron 10 enclosing the skeletal assembly 12. The equalateral tetrahedron 10 is the most stable articulated structure that can be formed from line elements. The skeletal tetrahedron has maximum symmetry (i.e., cubic), with the minimum number of struts per mode (i.e., four) for a 3D articulated structure, while retaining much of the rigidity of the basic tetrahedron.

Figure 2:
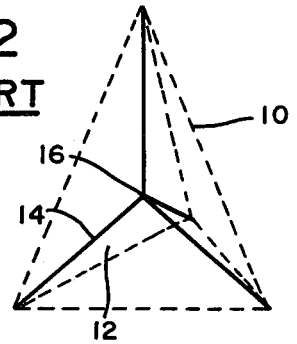
FIG. 2 PRIOR ART
FIGS. 2, 2A, and 2B show, respectively, an equilateral tetrahedron and its complementary skeletal-tetrahedron; an articulated skeletal-tetrahedric unit, its component struts being received onto a male-node, and into a female-node.
Figure 2A:
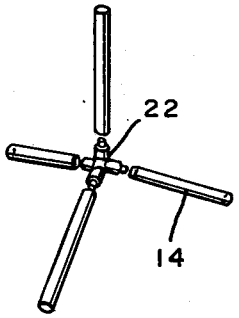
FIG. 2A PRIOR ART

In FIGS. 2 and 2A an articulated skeletal-tetrahedric unit 14 is shown wherein four struts 14 are received and joined onto four protrusions respectively of a male-node 22, the assembly forming a skeletal equilateral tetrahedron. The struts and the nodes may optionally be hollow to minimize the weight of the unit.

Figure 2B:
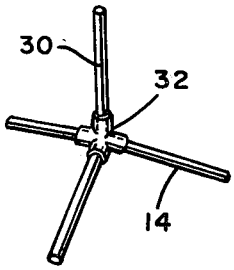
FIG. 2B PRIOR ART

In FIG. 2B another articulated skeletal-tetrahedric unit 30 is shown wherein four struts 14 are received into the four receptacles of a female-node 32. The conventional embodiments are shown to define the desired geometry.

The preferred embodiment of the tetrahedral truss of the present invention and its method of construction is shown in FIGS. 3 to 6. In FIG. 3, a fundamental bilateral-element 80 is shown having equal sides 82 and having an included angle 84 of about 109 degrees, 28 minutes of arc, i.e., the angle between the struts of a skeletal equilateral tetrahedron. Optional features may be included to facilitate joining of a plurality of bilateral-elements, such as a structural pin 86 at one extremity and a complementary, close-fitting receptacle 88 at the other extremity. The bilateral-elements may be made of conventional alloys, preferably those having high specific strength.

Six bilateral-elements 80 are assembled into the hexagonic triplanar-ring 90, as shown in the exploded plan-view, plan-view, and side-view, respectively, of FIGS. 3A, 3B, and 3C. It is noted that these triplanar-ring elements are exceptionally rigid under torsional loading. This rigidity contributes substantially to the stability and rigidity of the truss formed by assembling the rings. The joints may be secured by conventional fusion joining means or by adhesive joining means and the like.

Figure 4:
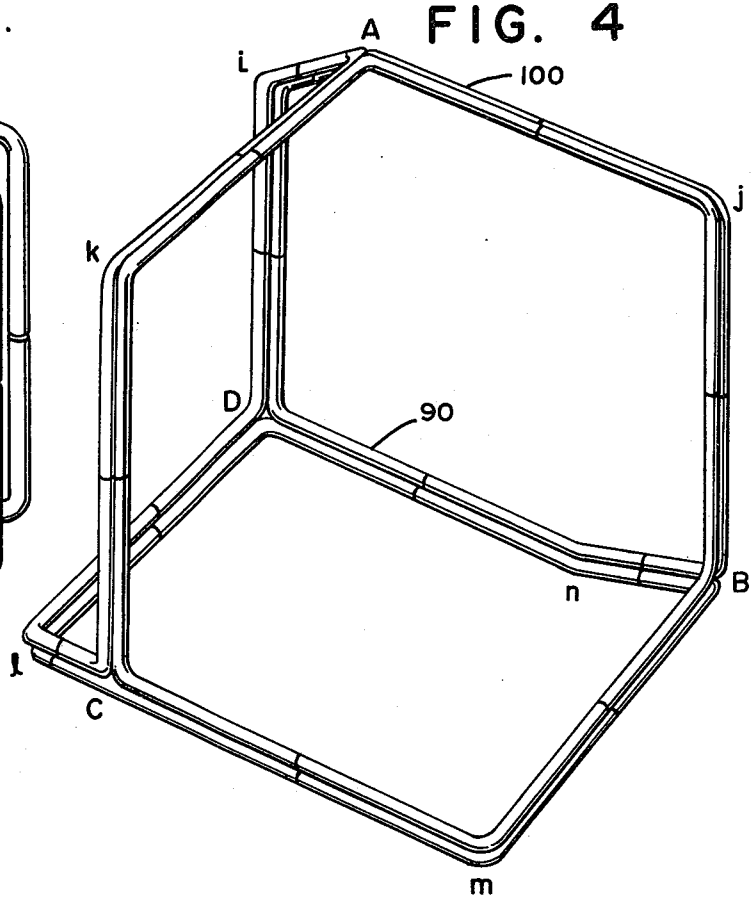
FIGS. 4 and 4A show, respectively, a closed skeletal-tetrahedric unit and its assembly from four hexagonic triplanar rings.
Figure 4A:
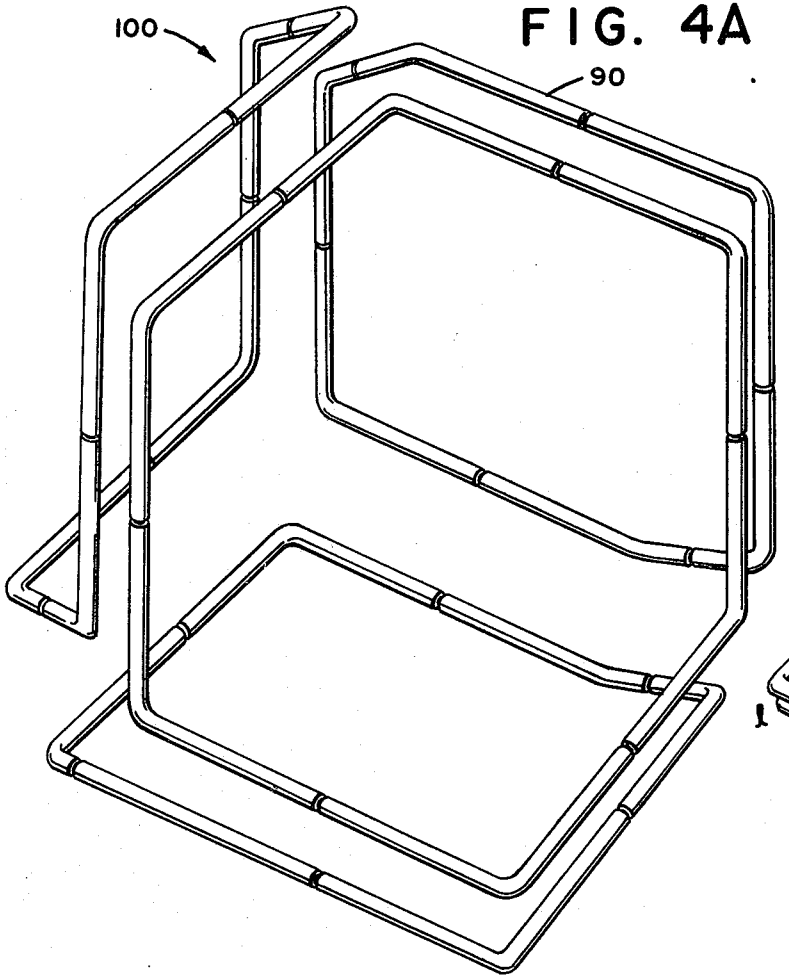

Four hexagonic triplanar-rings 90 are assembled into the unit 100 as shown in FIGS. 4 and 4A. Rigid joining of the rings may be by conventional mechanical means such as bolting, riveting, strapping, clamping, and the like, or by conventional fusion joining. To clarify the derivation of the unit and to emphasize that it is in fact a skeletal-tetrahedric structure, reference is made to its three-fold and two-fold corners. Of the former (e.g. the three-fold corners) the structure has four labelled, A,B,C, and D in FIG. 4, and these correspond to the four corners of a tetrahedron. Of the latter, it has six labelled i,j,k,l,m, and n in FIG. 4, and these correspond to the six sides of a tetrahedron. The closed tetrahedric unit 100 is preferred over the articulated tetrahedric unit 12 (FIG. 2) because points of stress concentration at strut-node joints are eliminated; thereby reducing the material (weight) needed for a given structure.

Figure 5:
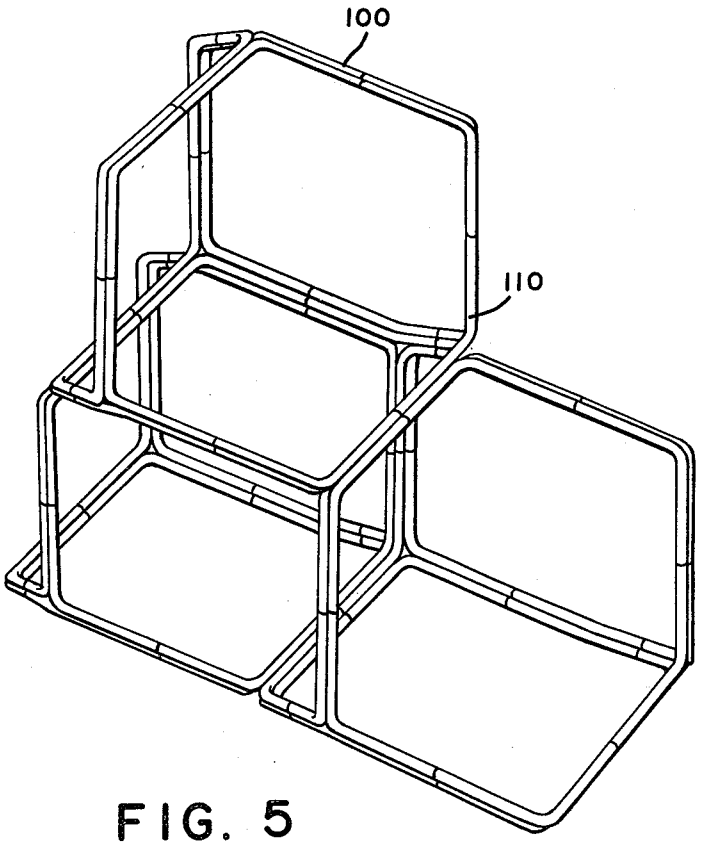
FIGS. 5 and 5A show, respectively, a perspective view and an exploded view of three closed skeletal-tetrahedric units stacked in a cooperative fashion.
Figure 5A:
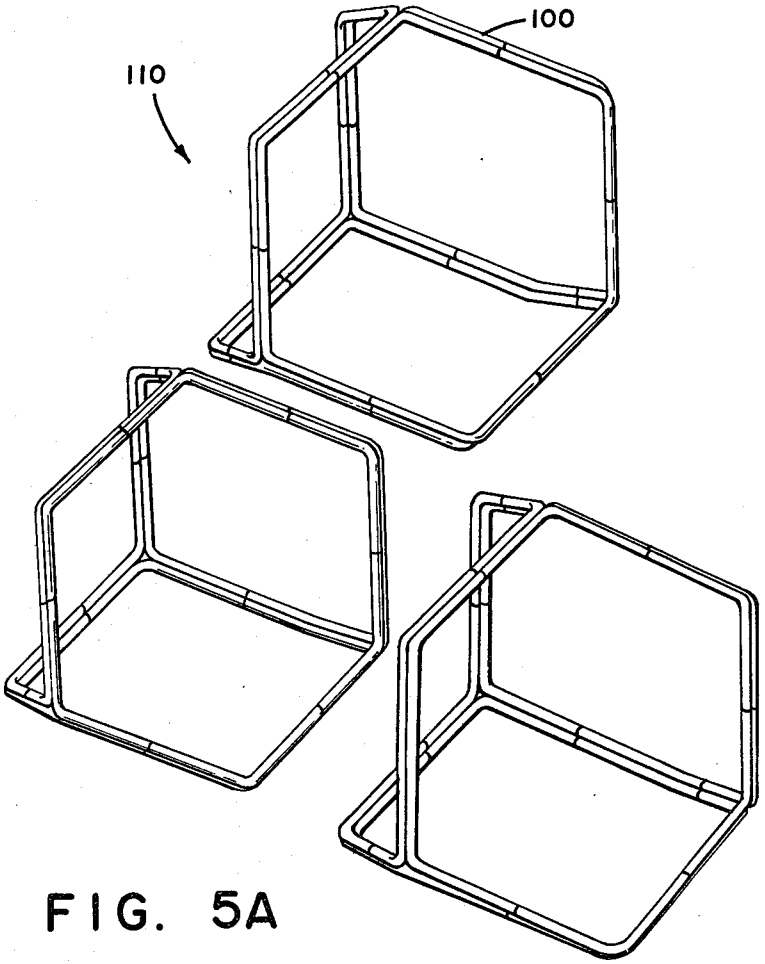

A plurality of tetrahedric units 100 are cooperatively stacked (nested), as shown in FIGS. 5 and 5A to build up a tetrahedral truss 110. Rigid joining of neighboring tetrahedric units 100 may be accomplished by conventional means as discussed above. Note that a skeletal equilateral tetrahedron is completed at each juncture of neighboring units 100, thereby obtaining the cubic-diamond structure (FIG. 1).

Figure 6:
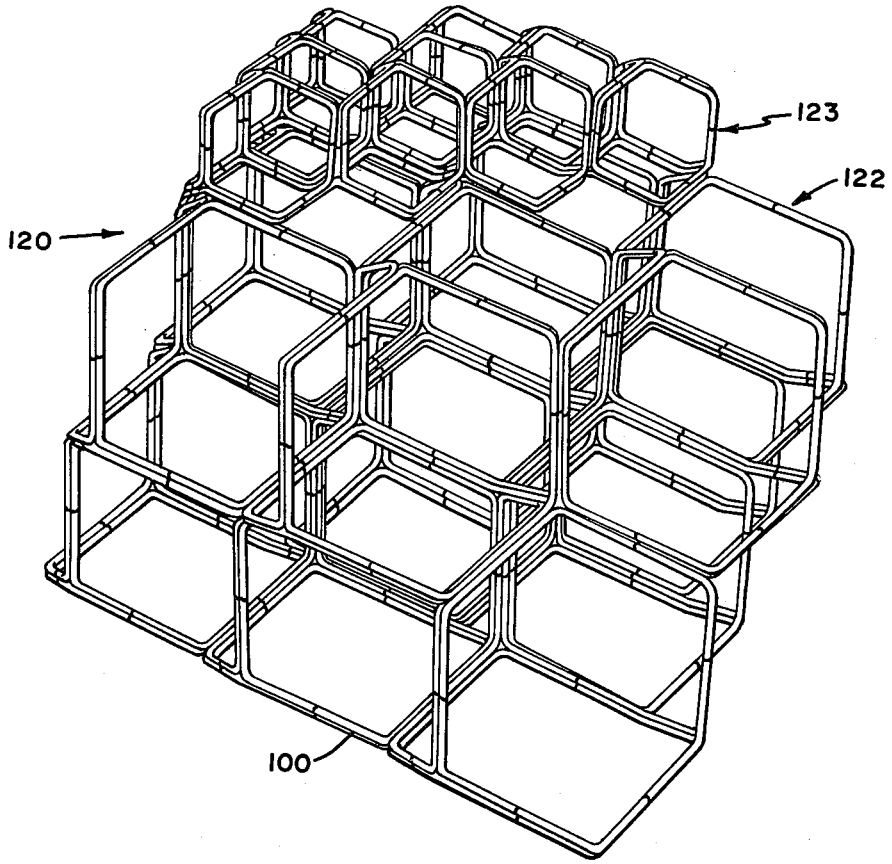
FIGS. 6 and 6A show, respectively, a perspective view and an exploded view of a graded truss built up from a plurality of closed skeletal-tetrahedric units and having layers of different characteristic dimensions.
Figure 6A:
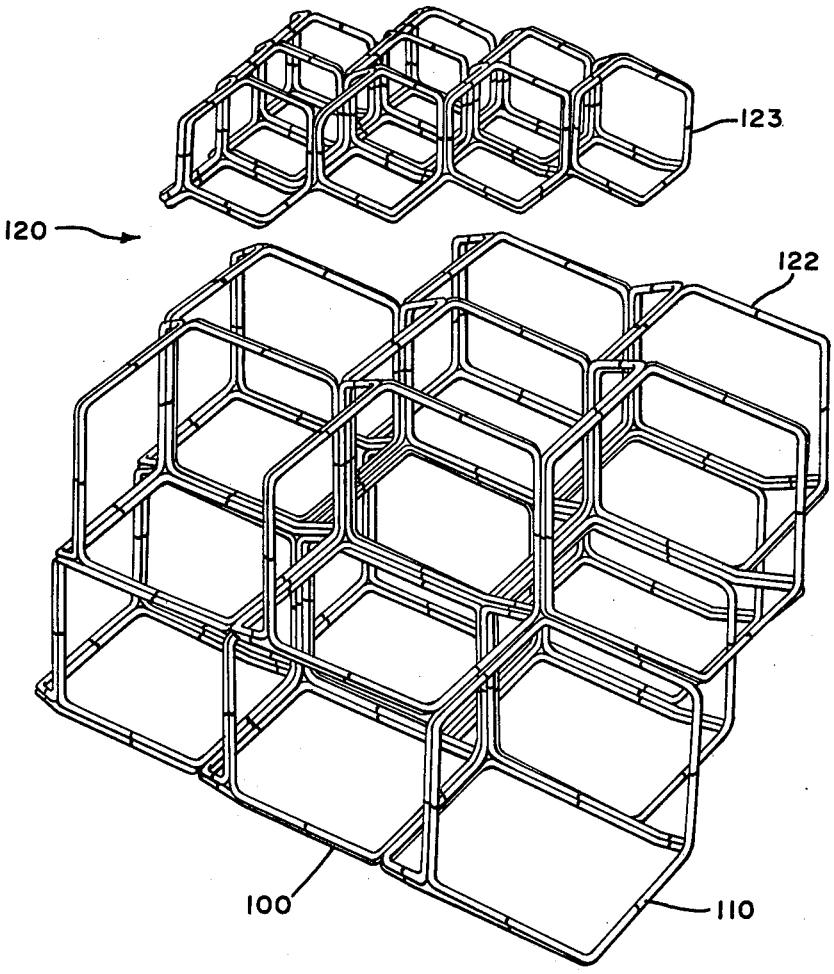

In FIG. 6, the tetrahedral truss 110 of FIG. 5 is shown with further three dimensional extension 122, i.e., repeated units 100. Additionally, the simplicity with which a graded truss 120 (e.g., having layers 122 and 123) may be built up is shown. By varying the characteristic dimension of adjacent layers by an integer power of the fraction one-half, adjacent layers may be cooperatively stacked, as shown in the exploded perspective view of FIG. 6A. Thus, a tetrahedral truss may readily be constructed having a relatively "smooth" outer surface with an open supporting structure in the interior portions of the truss.

There are alternative methods for forming the hexagonic triplanar-ring 90 (FIG. 3), having the advantage that a jointless element is obtained. For example, the ring may be mechanically shaped from a linear member of structural alloy and fusion joined to close the ring, with perhaps subsequent heat treatment, e.g., precipitation hardening. Alternatively, it may be forged from a ring. As another alternative, the material from which the ring is formed may be a fiber-reinforced composite. As a further alternative, the ring may be constructed or oriented graphite according to conventional methods; e.g., by pyrolyzing a shaped winding of organic fiber under orienting tension.

Figure 7:
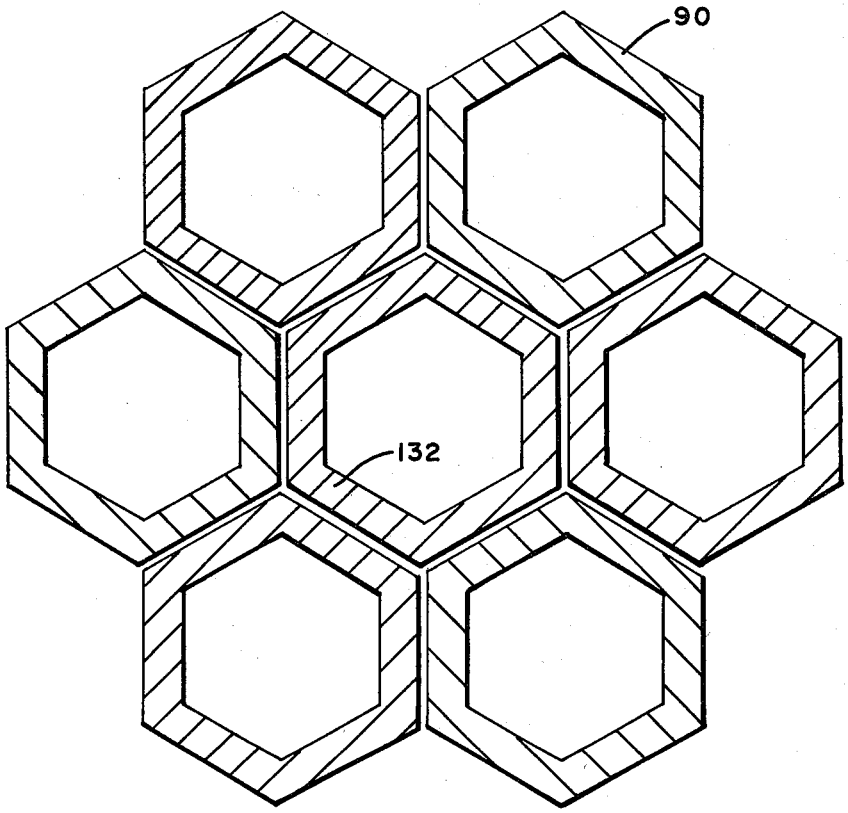
FIG. 7 shows an optional cross-sectional configuration at the juncture of adjacent, closed tetrahedric units.

In FIG. 7, an optional feature is shown for promoting the rigidity at the junctures between neighboring closed skeletal-tetrahedric units 100 (FIG. 5). A cross-sectional cut is taken through such juncture. As shown, the hexagonic triplanar-rings 90 may be of hexagonal cross-section, rather than of circular cross-section as shown in the preceeding drawings. A linear, close fitting filler rod 132, also of hexagonal cross-section, is inserted between neighboring rings 90. The members are shown as being hollow to minimize the weight.

Although the present invention has been described in conjunction with preferred embodiments, it is to be understood that modifications and variations may be utilized without departing from the principles and scope of the invention as those skilled in the art will readily understand. Accordingly, such modifications and variations may be practiced within the scope of the following claims:

What is claimed is:

1. A structural element for constructing a tetrahedral truss in the pattern of cubic-diamond, comprising:

a closed skeletal-tetrahedric unit, said unit being comprised of four hexagonic triplanar-rings joined along the length dimensions of adjacently located and cooperatively mating sides thereof to form said unit each of said rings having six equilateral sides the intersections of which form included angles of about 109°, 28 minutes.

said ring having the configuration of a closed, triplanar pattern, and the sides of said ring being adapted to cooperatively mate along the length dimensions thereof with adjacently located and similarly configured hexagonic triplanar-rings to form said unit.

2. A structural element for constructing a tetrahedral truss in the pattern of cubic-diamond, comprising:

a hexagonic triplanar-ring, said ring having six equilateral sides the intersections of which form included angles of about 109°, 28 minutes, said ring having the configuration of a closed, triplanar pattern, and the sides of said ring being adapted to cooperatively mate along the length dimensions thereof with adjacently located and similarly configured hexagonic triplanar-rings to form said truss.

3. A three-dimensional, tetrahedral truss, comprising:

a three-dimensionally, periodic skeletal array of an interconnected plurality of closed skeletal-tetrahedric units, said array being in the pattern of the cubic-diamond structure, each of said closed skeletal-tetrahedric units being adapted to cooperatively nest and join to one another along the length dimensions of adjacently located and cooperatively mating sides thereof to form said truss, each of said closed skeletal-tetrahedric units being comprised of four hexagonic triplanar-rings joined along the length dimensions of adjacently located and cooperatively mating sides thereof to form said unit, said triplanar-rings each having six equilateral sides in the configuration formed by joining 6 bilateral-elements in a closed ring, triplanar pattern, and said bilateral-elements each having equal sides and having an included angle of about 109 degrees, 28 minutes of arc.

4. The truss of claim 3 wherein each of said hexagonic triplanar-rings is composed of oriented graphite.

5. The truss of claim 3, wherein:

the characteristic dimension of said closed skeletal-tetrahedric units varies layer-wise within said truss by an integer power of the fraction one-half (FIG. 6).

6. A truss as recited in claim 3, wherein each of said hexagonic triplanar-rings has the configuration of a jointless ring.

7. A method for constructed a three-dimensional, tetrahedral truss, comprising the steps of:

(a) cooperatively nesting a plurality of closed skeletal-tetrahedric units; and (b) rigidly assembling said units along the length dimensions of adjacently located and cooperatively mating sides thereof to form a three-dimensionally periodic skeletal array, said array being in the pattern of the cubic-diamond structure, said units (100) each being comprised of four hexagonic triplanar-rings joined along the length dimensions of adjacently located and cooperatively mating sides thereof to form said unit, said triplanar-rings each having six equilateral sides in the configuration formed by joining 6 bilateral-elements in a closed ring, triplanar pattern, and said bilateral-elements each having equal sides and having an included angle of about 109 degrees, 28 minutes of arc.

* * * * *